US008496393B2

(12) United States Patent
Martin et al.

(10) Patent No.: US 8,496,393 B2
(45) Date of Patent: Jul. 30, 2013

(54) REFILLABLE TOOTHPASTE DISPENSING TOOTHBRUSH

(76) Inventors: Bruce Martin, Esterhazy (CA); Audrey Rose Erb, Esterhazy (CA)

( * ) Notice: Subject to any disclaimer, the term of this patent is extended or adjusted under 35 U.S.C. 154(b) by 293 days.

(21) Appl. No.: 12/832,041

(22) Filed: Jul. 7, 2010

(65) Prior Publication Data

US 2010/0272500 A1 Oct. 28, 2010

Related U.S. Application Data

(60) Provisional application No. 61/319,441, filed on Mar. 31, 2010.

(51) Int. Cl.
*B05C 17/01* (2006.01)
*A46B 11/04* (2006.01)

(52) U.S. Cl.
USPC ..... 401/282; 401/171; 401/172; 15/167.1

(58) Field of Classification Search
USPC .. 401/171–175, 282; 15/167.1–167.2; 433/80
See application file for complete search history.

(56) References Cited

U.S. PATENT DOCUMENTS

| | | | | | |
|---|---|---|---|---|---|
| 3,685,080 | A * | 8/1972 | Hubner | 15/22.1 |
| 3,938,897 | A | 2/1976 | Craig | |
| 4,049,354 | A * | 9/1977 | O'Rourke | 401/134 |
| 4,116,570 | A | 9/1978 | Parenti | |
| 4,277,194 | A | 7/1981 | Smith | |
| 4,622,984 | A | 11/1986 | Gaebel | |
| 4,826,341 | A | 5/1989 | Kwak | |
| 5,909,977 | A * | 6/1999 | Kuo | 401/146 |
| 5,927,889 | A * | 7/1999 | La Flower | 401/268 |
| 6,273,629 | B1 | 8/2001 | Jordan | |
| 6,648,641 | B1 * | 11/2003 | Viltro et al. | 433/80 |
| 6,957,925 | B1 | 10/2005 | Jacobs | |
| 7,244,073 | B2 * | 7/2007 | Trocino | 401/277 |
| 2003/0215282 | A1 * | 11/2003 | Edwards et al. | 401/277 |
| 2004/0057773 | A1 * | 3/2004 | Gray | 401/277 |
| 2008/0089733 | A1 * | 4/2008 | Lochak | 401/180 |
| 2009/0119859 | A1 * | 5/2009 | Podolsky | 15/167.1 |
| 2012/0103355 | A1 * | 5/2012 | Bowie | 132/200 |

* cited by examiner

*Primary Examiner* — David Walczak
*Assistant Examiner* — Jennifer C Chiang
(74) *Attorney, Agent, or Firm* — Danel Boudwin

(57) ABSTRACT

A refillable toothpaste dispensing toothbrush has a toothpaste containing capsule for dispensing toothpaste through the bristle head of the toothbrush. The toothpaste capsule can be filled using any standard toothpaste tube. Grooves in the toothpaste passageway prevent clogging of toothpaste in the toothbrush. In an alternate embodiment, the dispensing toothbrush also contains a sonic vibrating device.

9 Claims, 3 Drawing Sheets

REFILLABLE TOOTHPASTE DISPENSING TOOTHBRUSH

CROSS REFERENCE TO RELATED APPLICATION

This application claims the benefit of U.S. Provisional Application No. 61/319,441 filed on Mar. 31, 2010, entitled "Easy Brush"

BACKGROUND OF THE INVENTION

Toothpaste dispensing toothbrushes are known in the prior art; however, several drawbacks have prevented them from finding wide spread use in the industry. The present invention seeks to solve these drawbacks, including preventing toothpaste clogs and allowing for easy cleaning of reusable parts as well as easy, cost effective replacement of replaceable parts. The present invention easily disassembles into three main components, each serving a specific, unique purpose, and each being specifically designed for replacement or cleaning.

FIELD OF THE INVENTION

The present invention relates to an improved toothpaste dispensing toothbrush.

DESCRIPTION OF THE PRIOR ART

U.S. Pat. No. 4,622,984 to Gaebel discloses a toothbrush and toothpaste dispenser comprised of a hand manipulated rotating shaft with a transparent indicator window and is capable of dispensing toothpaste through the bristles.

U.S. Pat. No. 6,273,629 to Jordan discloses a toothpaste dispensing toothbrush that is capable of dispensing paste through the bristles. The toothbrush body has a hollow interior that stores a paste container and dispenses it through a stem. The device is controlled by a button that, when pressed, forces paste through the stem.

U.S. Pat. No. 7,244,073 to Trocino discloses a toothpaste dispensing toothbrush that contains a refillable paste container in the body. The refillable container is actuated by a plunger that, when twisted, forces toothpaste through the bristles of the brush. The brushing end of the toothbrush is removable and changeable.

U.S. Pat. No. 4,277,194 to Smith also discloses a toothpaste dispensing toothbrush wherein the paste container is actuated by a plunger that, when twisted, forces toothpaste through the bristles of the brush. However, the Smith device uses disposable paste containers rather than refillable ones.

U.S. Pat. No. 4,826,341 to Kwak, U.S. Pat. No. 3,938,897 to Craig and U.S. Pat. No. 4,116,570 to Parenti each disclose a toothbrush device with a built in standard toothpaste dispenser tube and a handle that slidably dispenses the paste through the bristles.

While effective in dispensing toothpaste, these prior art devices have several known drawbacks. Toothpaste regularly clogs the passageway, causing the brush to become inoperable until cleaned. Toothpaste storage means are either specially designed disposable tubes, which require higher costs to replace, or re-useable capsules that may be difficult to fill and clean. Furthermore, inadequate filling ports have been known to cause toothpaste to flow out of the port while filling, which creates an undesirable mess.

SUMMARY OF THE INVENTION

In view of the foregoing disadvantages inherent in the known types of toothpaste dispensing toothbrushes now present in the prior art, the present invention provides a new toothpaste dispensing toothbrush wherein the same can be utilized for providing convenience for the user when brushing their teeth.

It is therefore an object of the present invention to provide a toothpaste dispensing toothbrush that can be easily disassembled for cleaning and maintenance. The present invention breaks down into three main components, each of which can be easily cleaned or replaced.

Another object of the present invention is to provide a toothpaste dispensing toothbrush that does not clog with toothpaste. The present invention has a plurality of groves in the toothpaste passageway to ensure moist toothpaste remains in the passageway. Moist toothpaste makes it easier to clear dried toothpaste from the outlet port of the toothbrush.

Yet another object of the present invention is to provide a universal fitting for a refillable toothpaste capsule. The present invention has a tapered inlet port on the refillable toothpaste capsule that is capable of receiving any size toothpaste tubes for clean, easy refilling.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
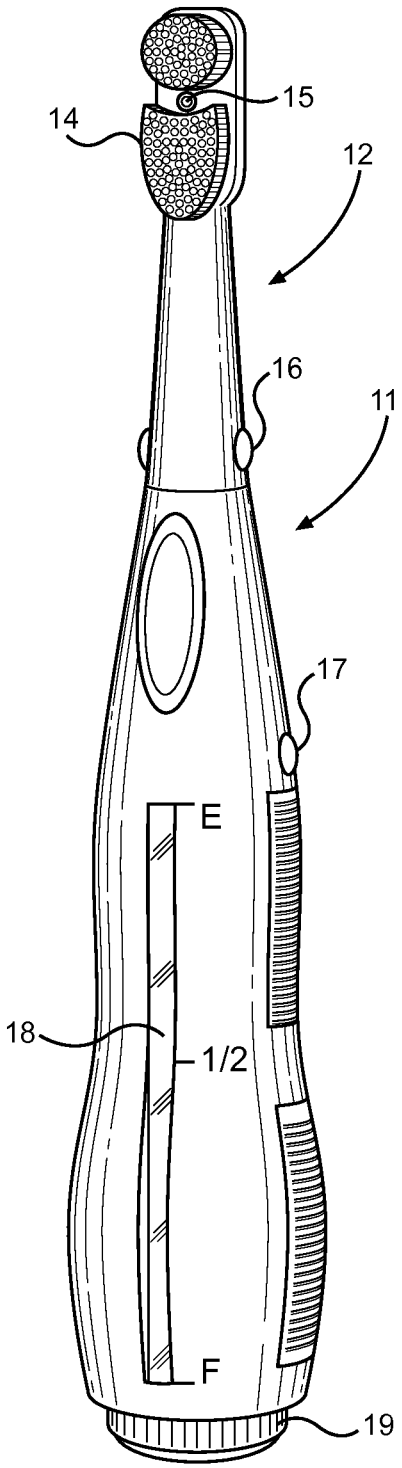
FIG. 1 Shows a perspective view of the dispensing toothbrush.
Figure 2:
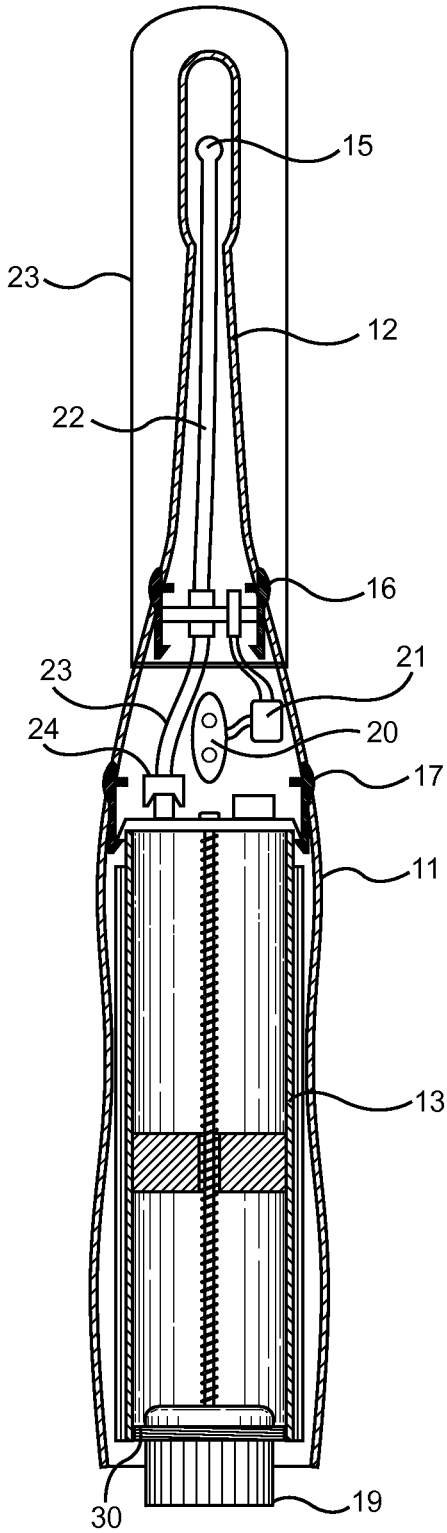
FIG. 2 Shows a side cross sectional view of the dispensing toothbrush.

Referring now to FIG. 1, there is shown a perspective view and FIG. 2, there is shown a front cross sectional view of the dispensing toothbrush. The toothbrush is made of three main components, including a neck 12, a hollow toothbrush body 11, and a toothpaste capsule 13. The neck is intended to be removed and replaced when the bristles 14 are worn out. The upper bristle end of the neck 12 forms the toothbrush head 27. The head has a plurality of bristles 14 on its exterior surface and a toothpaste outlet port 15 in between the bristles for dispensing toothpaste onto the bristles. At the lower end of the neck are two pressure grips 16 for removably attaching the neck to the top surface 50 of the body 11. The body has a transparent slit 18 with graduated marking for monitoring the level of toothpaste in the toothpaste capsule. The capsule is preferably made from a transparent material so that the volume of toothpaste can be viewed. At the tapered upper end 51 of the body are two pressure grips 17 for attaching to the toothpaste capsule. A cap 23 covers the neck when the toothbrush is not in use. Use of the cap prevents bacteria from contaminating the bristles when the brush is not in use.

Figure 3:
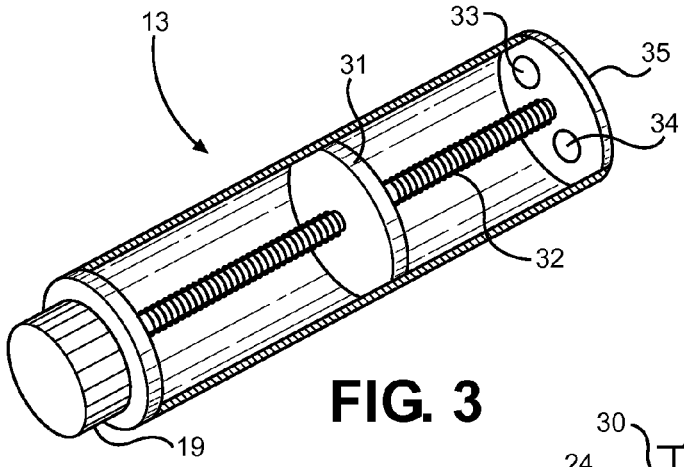
FIG. 3 Shows a perspective cross section view of the toothpaste capsule.
Figure 4:
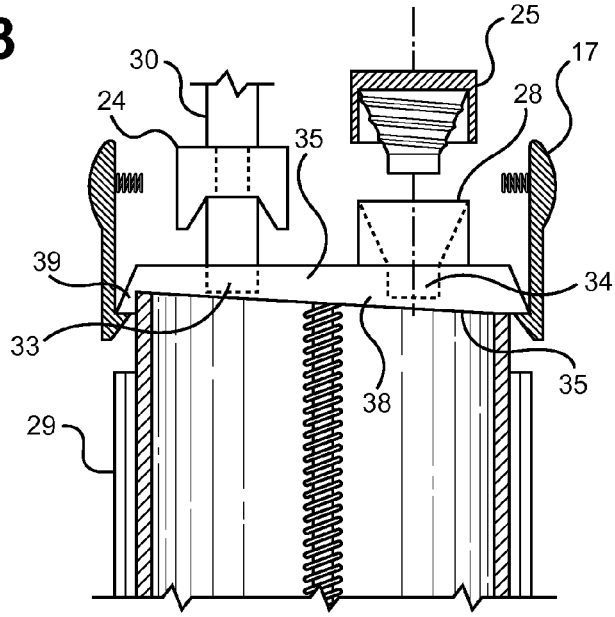
FIG. 4 Shows a front cross sectional view of the top of the toothpaste capsule joining to the tapered upper end of the toothbrush body.

Referring now to FIG. 3, there is shown a perspective cross sectional view of the toothpaste capsule 13, and FIG. 4, there is shown a front cross sectional view of the toothpaste capsule joining with the body. The capsule has an interior volume for storing toothpaste and a screw shaft 32 and plunger 31. The screw shaft is attached to the upper surface and lower surface of the capsule.

A rotating knob 19 with threads 30 is screwed into the lower end of the capsule and is attached to the screw shaft. The knob can be unscrewed to access the interior of the capsule for cleaning. In an alternate embodiment, the knob can be formed as part of the toothpaste capsule. Rotating the knob causes the screw shaft to rotate. The plunger 31 is threadedly attached to the screw shaft so that rotation of the knob causes the plunger to traverse the screw shaft. The plunger has a soft rubber circumferential surface to ensure a tight seal between it and the interior walls of the capsule. Alternatively, the plunger can have an O-ring or similar sealing member to ensure a proper seal.

The upper surface of the capsule has an inlet port 28 and an outlet port 33. The inlet port has a threaded, tapered interior for threadedly receiving various size toothpaste tubes. The threads are discontinuous to further accommodate a variety of difference size tubes. A toothpaste tube can be threadedly attached to the capsule inlet port for refilling the capsule with toothpaste. Once the capsule is filled, the toothpaste tube is removed and a threaded cap 25 is threadedly attached to the capsule inlet port to ensure toothpaste does not exit through it. The capsule outlet port 33 mates with the body inlet port 24 located on a mid surface 52 that separates the upper and lower ends of the body. When the knob is turned, toothpaste is forced out through the capsule outlet port and into a body passageway 26 inside the tapered upper end of the body. The interior side 38 of the capsule's upper surface 35 is sloped, causing the upper surface to have a tapered thickness. The thickness is greatest at the inlet port, which causes the plunger to contact the inlet side of the surface first, thus ensuring the last amount of toothpaste is forced out through the outlet port. The upper surface has a circumferential lip 39 for the pressure grips to grasp. The capsule can be inserted into the open base 53 of the tubular lower end 54 of the body 11 until it latches the pressure grips. To remove the capsule the pressure grips are pressed inward, causing them to release the capsule.

Figure 5:
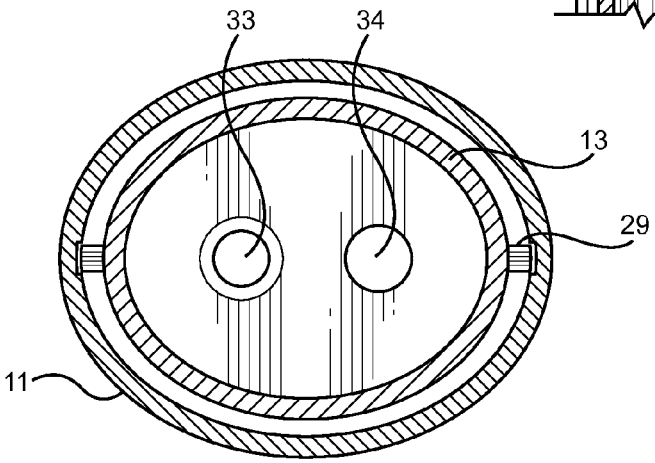
FIG. 5 Shows a bottom cross sectional view of the toothpaste capsule inserted in the toothbrush body.

FIG. 5 illustrates the non-circular shape of the toothpaste capsule 13 and body 11. This is essential to restrain the rotational degree of freedom of the plunger, ensuring that it traverses the screw shaft. On opposite sides of the capsule's exterior surface are two longitudinal protrusions 29. These protrusions align with longitudinal slits 43 on the interior surface of the body. Proper alignment of the capsule is important to ensure that the outlet port 33 mates with the inlet port 24 of the body.

Figure 6:
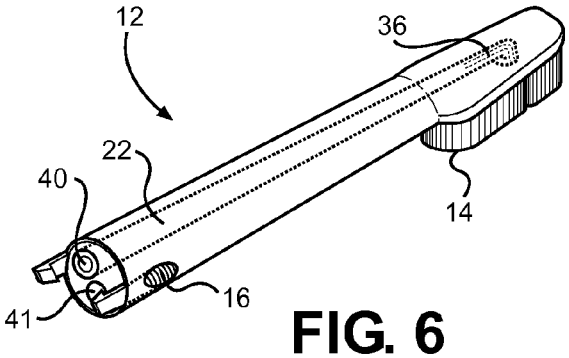
FIG. 6 Shows a perspective view of the toothbrush neck.

Referring now to FIG. 6, there is shown a perspective view of the toothbrush neck. At the lower attach end 55 of the neck 12 is a neck inlet port 40 for receiving toothpaste from the body. An internal passageway 22 in the neck communicates toothpaste from the neck inlet port to the toothpaste outlet port 15 on the head. Also on the lower attach end of the neck is a cavity 41 for receiving a sonic vibrating device 21 which is commonly used in the oral hygiene industry for vibrating the neck and head of the toothbrush. The sonic vibrating device 21 is shown in FIG. 2, along with an on/off switch 20. The sonic device is located in the tapered upper end of the body, with the vibrating head 56 protruding through the top surface of the body so as to communicate the vibrations to the neck when the neck is attached.

Figure 7:
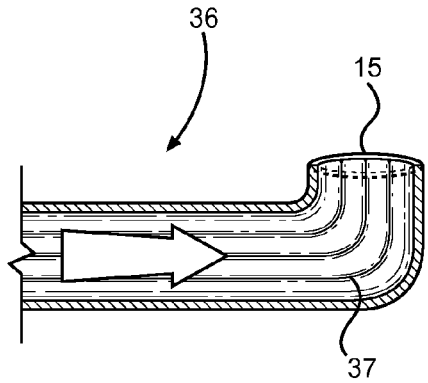
FIG. 7 Shows a side cross sectional view of the internal grooves near the toothpaste outlet port at the head end of the toothbrush neck.

Referring now to FIG. 7, there is shown a cross sectional view of the clog resistant toothpaste passageway 36 in the head of the neck, near the outlet port. Toothpaste clogs have long been a drawback in the field of dispensing toothbrushes. The present invention solves this problem by forming a plurality of grooves 37 on the internal surface of the internal toothpaste passageway 36 in the neck. The grooves are only required near the bend in the passageway, just before the exit port 15, as this is where clogging typically occurs. The grooves can be longitudinal, as shown, or a radial spiral. Radial grooves would be similar to a threaded interior with a large thread pitch. The grooves collect wet toothpaste in an airtight environment, thus preventing the toothpaste from drying out. The wet toothpaste in the grooves makes it easier to push out dried toothpaste near the outlet port.

Figure 8:
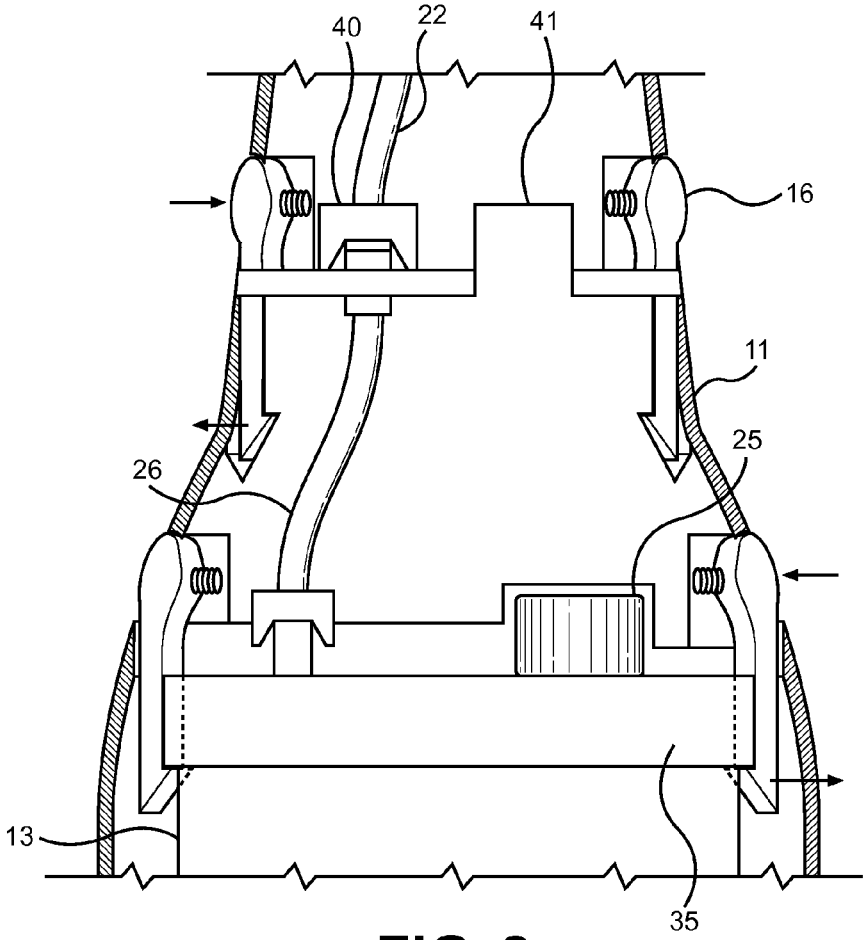
FIG. 8 Shows a front cross sectional view of the tapered upper end of the toothbrush body joining with the toothbrush neck and toothpaste capsule.

Referring now to FIG. 8, there is shown a cross sectional view of the connection between the tapered upper end 51 of the body 11, the neck 12, and the capsule 13. The neck is snapped onto the body with two pressure grips 16 grasping notches 44 on the side wall of the body. The inlet port 40 of the neck will mate with the outlet port 45 of the body. A body passageway 26 connects the inlet port 24 of the body with the outlet port 45 of the body for transferring toothpaste from the capsule to the neck.

In use an individual can remove the capsule from the toothbrush body, cap the outlet port to prevent paste from flowing out, screw a toothpaste tube into the universal inlet port and squeeze paste into the capsule. Once the capsule is filled, it can be inserted into the toothbrush and locked into place by the pressure tabs. The grooves will ensure its proper alignment so that the capsule and body ports align. The knob is turned and paste is dispensed through the head.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A toothpaste dispensing toothbrush for storing and dispensing toothpaste comprising, in combination:

a replaceable toothbrush neck portion with an internal passageway for communicating toothpaste from a neck inlet port located at a lower attach end of said neck to a toothpaste outlet port located at an upper bristle end of said neck, wherein said upper bristle end has a plurality of bristles formed around said toothpaste outlet port of said internal passage;

a hollow toothbrush body having a tapered upper end with a top surface, a body outlet port located on said top surface, and a tubular lower end with an open base for receiving a toothpaste capsule; a mid surface separating said tapered end from said tubular end, said mid surface having a body inlet port attached thereto; a body passageway attached to said body inlet port of said mid surface and said body outlet port of said top surface of said tapered end for communicating toothpaste from said toothpaste capsule to said internal passageway in said neck;

said toothpaste capsule being of non-circular cross section and having an upper surface, a lower surface, and an interior volume for storing toothpaste; a capsule inlet port and a capsule outlet port on said upper surface, said outlet port inserts into said inlet port of said mid surface in said body; a rotating knob at said lower end of said capsule is fixed to a screw shaft in the center of said capsule, wherein rotation of said knob causes said screw shaft to rotate; a plunger member threadedly attached to said screw shaft, wherein rotation of said knob causes said plunger member to traverse said screw shaft and force toothpaste through said outlet port;

said inlet port on said upper surface of said capsule having a threaded tapered interior for receiving a variety of different size toothpaste tubes, said threaded interior having a longitudinal slit through said threads to further accommodate multiple size toothpaste tubes, wherein toothpaste tubes transfer toothpaste into said capsule, and a tapered threaded cap seals said inlet port when said toothpaste tube is removed.

2. The apparatus of claim 1, wherein said capsule has an exterior surface with two longitudinal protrusions, said protrusions align with longitudinal slits in said tubular lower end of said body to provide correct alignment of said ports.

3. The apparatus of claim 1, wherein said body has an interior volume, said interior volume is viewed through a transparent slit on said hollow body, and graduated markings on said body for measuring a volume of toothpaste through said transparent slit.

4. The apparatus of claim 1, wherein said upper surface of said capsule has a varying thickness, said surface is thickest at said inlet port and thinnest at said capsule outlet port to direct toothpaste to said capsule outlet port.

5. The apparatus of claim 1, wherein said internal passageway has an internal surface with a plurality of grooves for preventing clogging of toothpaste therein.

6. The apparatus of claim 1, wherein said lower attach end has two pressure grips for attaching said neck to said toothbrush body.

7. The apparatus of claim 1, wherein said toothbrush body has two locking pressure grips that engage with a circumferential lip on said upper surface of said capsule for securing said toothpaste capsule in said tubular lower end of said body.

8. The apparatus of claim 1, wherein a sonic vibrator is attached in said tapered upper end of said body, whereby said sonic vibrator is controlled by a switch located on said tapered upper end of said body; a cavity on said base of said neck receives part of said sonic vibrator communicating vibrations to said bristles on said neck.

9. A toothpaste dispensing toothbrush for storing and dispensing toothpaste comprising, in combination:

a replaceable toothbrush neck portion with an internal passageway for communicating toothpaste from a neck inlet port located at a lower attach end of said neck to a toothpaste outlet port located at an upper bristle end of said neck, wherein said upper bristle end has a plurality of bristles formed around said toothpaste outlet port of said internal passage;

a hollow toothbrush body having a tapered upper end with a top surface, a body outlet port located on said top surface, and a tubular lower end with an open base for receiving a toothpaste capsule; a mid surface separating said tapered end from said tubular end, said mid surface having a body inlet port attached thereto; a body passageway attached to said body inlet port of said mid surface and said body outlet port of said top surface of said tapered end for communicating toothpaste from said toothpaste capsule to said internal passageway in said neck;

said toothpaste capsule being of non-circular cross section and having an upper surface, a lower surface, and an interior volume for storing toothpaste; a capsule inlet port and a capsule outlet port on said upper surface, said outlet port inserts into said inlet port of said mid surface in said body; a rotating knob at said lower end of said capsule is fixed to a screw shaft in the center of said capsule, wherein rotation of said knob causes said screw shaft to rotate; a plunger member threadedly attached to said screw shaft, wherein rotation of said knob causes said plunger member to traverse said screw shaft and force toothpaste through said outlet port;

said internal passageway having an internal surface with a plurality of grooves for preventing clogging of toothpaste therein.

* * * * *